US011359594B2

(12) United States Patent
Ohata

(10) Patent No.: US 11,359,594 B2
(45) Date of Patent: Jun. 14, 2022

(54) INTERNAL COMBUSTION ENGINE CONTROL DEVICE

(71) Applicant: HITACHI AUTOMOTIVE SYSTEMS, LTD., Hitachinaka (JP)

(72) Inventor: Eiichirou Ohata, Hitachinaka (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 0 days.

(21) Appl. No.: 17/056,334

(22) PCT Filed: Feb. 13, 2019

(86) PCT No.: PCT/JP2019/004960

§ 371 (c)(1),
(2) Date: Nov. 17, 2020

(87) PCT Pub. No.: WO2019/225070

PCT Pub. Date: Nov. 28, 2019

(65) Prior Publication Data

US 2021/0231093 A1 Jul. 29, 2021

(30) Foreign Application Priority Data

May 23, 2018 (JP) ..... JP2018-099160

(51) Int. Cl.
*F02P 9/00* (2006.01)
*F02P 3/05* (2006.01)

(52) U.S. Cl.
CPC ..... *F02P 9/002* (2013.01); *F02P 3/05* (2013.01)

(58) Field of Classification Search
CPC ..... F02P 9/002; F02P 3/05
USPC ..... 123/169 PB, 145 R, 145 A
See application file for complete search history.

(56) References Cited

U.S. PATENT DOCUMENTS 3,851,637 A * 12/1974 Green ..... H01T 13/18 123/169 PB
5,230,309 A * 7/1993 Suga ..... H01T 13/18 123/169 PB
6,009,848 A * 1/2000 Fujiwara ..... F02D 41/062 123/295

(Continued)

FOREIGN PATENT DOCUMENTS

JP S61-202682 U 12/1986
JP S62-20677 A 1/1987

(Continued)

OTHER PUBLICATIONS

International Search Report with English translation and Written Opinion issued in corresponding application No. PCT/JP2019/004960 dated May 21, 2019.

*Primary Examiner* — Hai H Huynh
(74) *Attorney, Agent, or Firm* — Foley & Lardner LLP

(57) ABSTRACT

An internal combustion engine control device includes an ignition control unit which executes an ignition control for controlling an ignition plug which discharges electricity in a cylinder of an internal combustion engine to ignite fuel. The ignition control unit executes the ignition control such that a predetermined ignition electric energy is supplied to the ignition plug when the ignition plug performs ignition, and a predetermined pre-heating electric energy smaller than the ignition electric energy is supplied to the ignition plug before the ignition plug performs ignition.

16 Claims, 10 Drawing Sheets

(56) References Cited

U.S. PATENT DOCUMENTS

| | | | | |
|---|---|---|---|---|
| 10,780,395 | B2 * | 9/2020 | Poojary | B01J 37/088 |
| 2020/0238972 | A1 | 7/2020 | Oohata | |

FOREIGN PATENT DOCUMENTS

| | | | |
|---|---|---|---|
| JP | H05-33698 | A | 2/1993 |
| WO | WO-2019/087748 | A1 | 5/2019 |

* cited by examiner (a) DURING COLD START (b) AFTER WARMING-UP

INTERNAL COMBUSTION ENGINE CONTROL DEVICE

TECHNICAL FIELD

The present invention relates to an internal combustion engine control device.

BACKGROUND ART

In recent years, in internal combustion engines, there is a demand for improving the performance of exhaust catalysts (three-way catalyst) as exhaust gas regulations are tightened. In exhaust catalysts of internal combustion engines, expensive precious metals such as platinum are used. However, as exhaust gas regulations are tightened, it is necessary to use many precious metals to improve exhaust performance, and the manufacturing cost of exhaust catalysts increases.

In this type of internal combustion engine, a large amount of hydrocarbons (HC) are generated especially at the time of cold start in which the temperature of the internal combustion engine is lower than the outside air temperature. Therefore, by suppressing the generation of hydrocarbons at the time of cold start, it is possible to reduce the amount of precious metal used in the exhaust catalyst and reduce the manufacturing cost of the exhaust catalyst.

However, in internal combustion engines, in order to prevent ignition failure (extinguishing) of the ignition device (ignition plug) at the time of cold start, control is performed to increase the fuel injection amount at the time of cold start. As a result, the amount of hydrocarbons generated at the time of cold start increases, and it becomes more difficult to reduce the cost of the exhaust catalyst.

In PTL 1, an engine ignition device is disclosed in which a temperature decrease of an ignition device is prevented when ignition of the ignition device is performed at a timing (exhaust timing) different from, a normal ignition timing in one combustion cycle of the internal combustion engine.

CITATION LIST

Patent Literature

PTL 1: JP 62-20677 A

SUMMARY OF INVENTION

Technical Problem

However, in the engine ignition device disclosed in PTL 1, the temperature decrease of the ignition plug is prevented after the temperature of the ignition plug of the internal combustion engine increases, and the temperature of the ignition plug increases before the cold start of the internal combustion engine. Therefore, it is not possible to suppress the generation of hydrocarbons in the internal combustion engine, especially at the time of cold start, and it becomes difficult to reduce the manufacturing cost of the exhaust catalyst.

Therefore, the present invention has been made in view of the above problems, and an object thereof is to suppress the generation of hydrocarbons in the internal combustion engine and reduce the manufacturing cost of the exhaust catalyst.

Solution to Problem

An internal combustion engine control device according to an aspect of the present invention includes: an ignition control unit which executes an ignition control for controlling an ignition plug which discharges electricity in a cylinder of an internal combustion engine to ignite fuel. The ignition control unit executes the ignition control such that a predetermined ignition electric energy is supplied to the ignition plug when the ignition plug performs the ignition, and a predetermined pre-heating electric energy smaller than the ignition electric energy is supplied to the ignition plug before the ignition plug performs the ignition.

An internal combustion engine control device according to another aspect of the present invention includes: an ignition control unit which controls energization of an ignition coil which provides electric energy to an ignition plug which discharges electricity in a cylinder of an internal combustion engine to ignite fuel. The ignition control unit controls the energization of the ignition coil such that the ignition plug is provided with the electric energy for heating the ignition plug before the ignition plug performs the ignition.

An internal combustion engine control device according to another aspect of the present invention includes: an ignition control unit which executes an ignition control for controlling an ignition plug which discharges electricity in a cylinder of an internal combustion engine to ignite fuel. The ignition control unit executes the ignition control such that an electric energy for causing the ignition plug to discharge electricity is supplied to the ignition plug in a period including at least an exhaust stroke in which the fuel after combustion is discharged from the cylinder.

Advantageous Effects of Invention

According to the present invention, it is possible to suppress the generation of hydrocarbons in the internal combustion engine and reduce the manufacturing cost of the exhaust catalyst.

DESCRIPTION OF EMBODIMENTS

First Embodiment

Hereinafter, an internal combustion engine control device according to a first embodiment of the present invention will be described.

Hereinafter, a control device 1 which is one mode of the internal combustion engine control device according to the first embodiment will be described. In this embodiment, a case where the control device 1 controls the discharge (ignition) of an ignition plug 200 provided in each cylinder 150 of a four-cylinder internal combustion engine 100 will be described as an example.

Hereinafter, in the embodiment, a combination of a partial or overall configuration of the internal combustion engine 100 and a partial or overall configuration of the control device 1 is referred to as the control device 1 of the internal combustion engine 100.

[Internal Combustion Engine]

Figure 1:
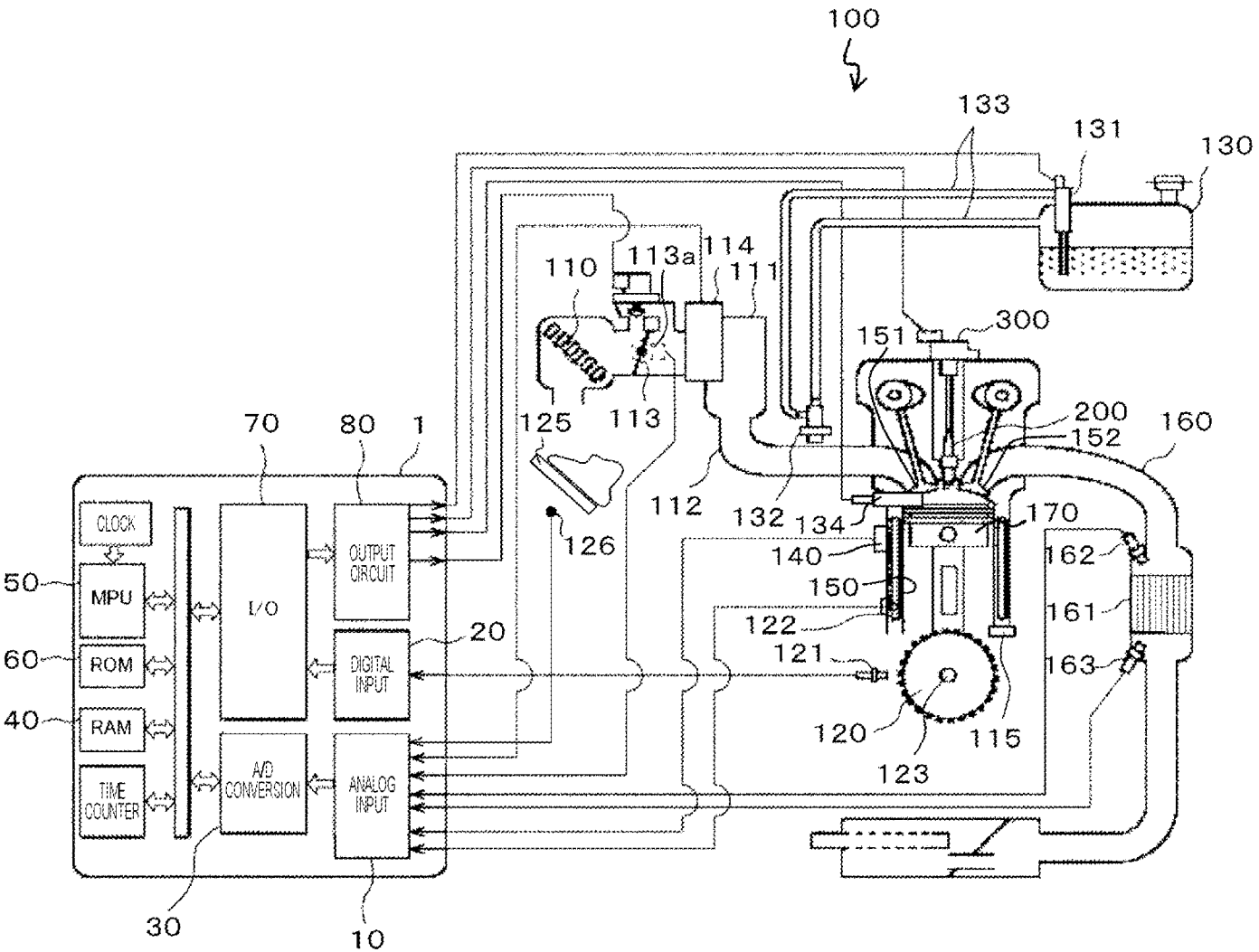
FIG. 1 is a diagram illustrating a main configuration of an internal combustion engine and an internal combustion engine control device for according to an embodiment.

FIG. 1 is a diagram illustrating a main configuration of the internal combustion engine 100 and the internal combustion engine ignition device.

Figure 2:
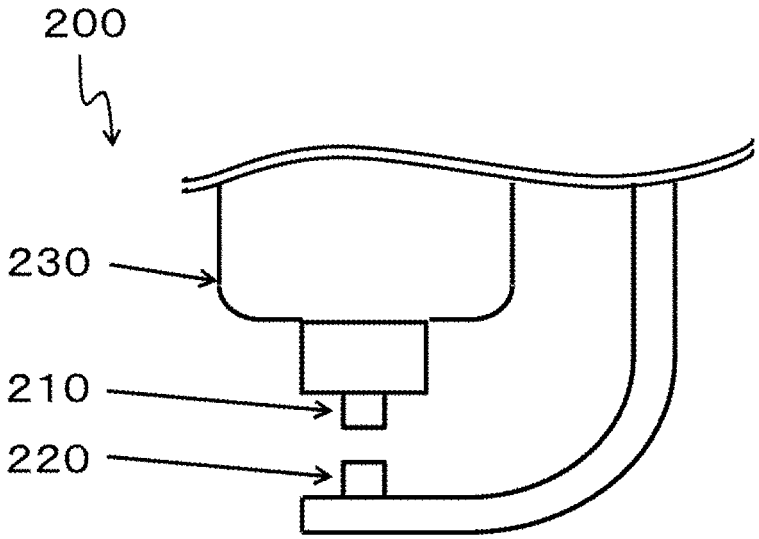
FIG. 2 is a partially enlarged view illustrating an ignition plug.

FIG. 2 is a partially enlarged view illustrating electrodes 210 and 220 of the ignition plug 200.

In the internal combustion engine 100, the air sucked from the outside flows through an air cleaner 110, an intake pipe 111, and an intake manifold 112, and flows into each cylinder 150 when an intake valve 151 opens. The amount of air flowing into each cylinder 150 is adjusted by a throttle valve 113, and the amount of air adjusted by the throttle valve 113 is measured by a flow rate sensor 114.

The throttle valve 113 is provided with a throttle opening sensor 113*a* which detects the opening of a throttle. The opening information of the throttle valve 113 detected by the throttle opening sensor 113*a* is output to the control device (Electronic Control Unit: ECU) 1.

Incidentally, as the throttle valve 113, an electronic throttle valve driven by an electric motor is used, but the throttle valve may be any other type as long as the flow rate of air can be appropriately adjusted.

The temperature of the gas flowing into each cylinder 150 is detected by an intake air temperature sensor 115.

A crank angle sensor 121 is provided outside a ring gear 120 attached to a crankshaft 123 in a radial direction. The crank angle sensor 121 detects the rotation angle of the crankshaft 123. In the embodiment, the crank angle sensor 121 detects the rotation angle of the crankshaft 123, for example, every 10° and each combustion cycle.

A water temperature sensor 122 is provided on a water jacket (not illustrated) of a cylinder head. The water temperature sensor 122 detects the temperature of the cooling water of the internal combustion engine 100.

A vehicle is provided with an accelerator position sensor (APS) 126 which detects a displacement amount (depression amount) of an accelerator pedal 125. The accelerator position sensor 126 detects the torque required by a driver. The torque required by the driver and detected by the accelerator position sensor 126 is output to the control device 1 described later. The control device 1 controls the throttle valve 113 on the basis of this required torque.

The fuel stored in a fuel tank 130 is sucked and pressurized by a fuel pump 131, then flows through a fuel pipe 133 provided with a pressure regulator 132, and is guided to a fuel injection valve (injector) 134. The fuel output from the fuel pump 131 is adjusted to have a predetermined pressure by the pressure regulator 132, and is injected from the fuel injection valve (injector) 134 into each cylinder 150. As a result of the pressure adjustment by the pressure regulator 132, excess fuel is returned to the fuel tank 130 via a return pipe (not illustrated).

The cylinder head (not illustrated) of the internal combustion engine 100 is provided with a combustion pressure sensor (CPS, also referred to as a cylinder pressure sensor) 140. The combustion pressure sensor 140 is provided in each cylinder 150 and detects the inner pressure (combustion pressure) of the cylinder 150.

As the combustion pressure sensor 140, a piezoelectric or gauge type pressure sensor is used, and the inner combustion pressure (in-cylinder pressure) of the cylinder 150 can be detected over a wide temperature range.

An exhaust valve 152 and an exhaust manifold 160 for discharging the gas (exhaust gas) after combustion to the outside of the cylinder 150 are attached to each cylinder 150. A three-way catalyst 161 is provided on the exhaust side of the exhaust manifold 160.

When the exhaust valve 152 is opened, exhaust gas is discharged from the cylinder 150 to the exhaust manifold 160. The exhaust gas purified by the three-way catalyst 161 while flowing through the exhaust manifold 160 and then is discharged to the atmosphere.

An upstream air-fuel ratio sensor 162 is provided on the upstream side of the three-way catalyst 161. The upstream air-fuel ratio sensor 162 continuously detects the air-fuel ratio of the exhaust gas discharged from each cylinder 150.

A downstream air-fuel ratio sensor 163 is provided on the downstream side of the three-way catalyst 161. The downstream air-fuel ratio sensor 163 outputs a switching detection signal in the vicinity of the theoretical air-fuel ratio. In the embodiment, the downstream air-fuel ratio sensor 163 is, for example, an O2 sensor.

Further, an ignition plug 200 is provided above each cylinder 150. Due to the discharge (ignition) of the ignition plug 200, a spark is ignited in the air-fuel mixture of air and fuel in the cylinder 150, an explosion occurs in the cylinder 150, and a piston 170 is pushed down. When the piston 170 is pushed down, a crankshaft 123 rotates.

An ignition coil 300 which generates electric energy (voltage) supplied to the ignition plug 200 is connected to the ignition plug 200. The voltage generated in the ignition coil 300 causes discharge between a center electrode 210 and an outer electrode 220 of the ignition plug 200 (see FIG. 2).

As illustrated in FIG. 2, in the ignition plug 200, the center electrode 210 is supported by an insulator 230 in an insulated state. A predetermined voltage (for example, 20,000 V to 40,000 V in the embodiment) is applied to this center electrode 210.

The outer electrode 220 is grounded. When a predetermined voltage is applied to the center electrode 210, a discharge (ignition) occurs between the center electrode 210 and the outer electrode 220.

Incidentally, in the ignition plug 200, the dielectric breakdown of the gas component occurs due to the state of the gas existing between the center electrode 210 and the outer electrode 220 or the in-cylinder pressure, and the voltage at which the discharge (ignition) occurs changes. This voltage at which the discharge occurs is referred to as a dielectric breakdown voltage.

The discharge control (ignition control) on the ignition plug 200 is performed by an ignition control unit 83 of the control device 1 described later.

Returning to FIG. 1, output signals from various sensors such as the throttle opening sensor 113*a*, the flow rate sensor 114, the crank angle sensor 121, the accelerator position sensor 126, the water temperature sensor 122, and the combustion pressure sensor 140 described above are output to the control device 1. The control device 1 detects the operating state of the internal combustion engine 100 on the basis of the output signals from these various sensors and controls the amount of air sent into the cylinder 150, the fuel injection amount, the ignition timing of the ignition plug 200, and the like.

[Hardware Configuration of Control Device]

Next, the overall hardware configuration of the control device 1 will be described.

As illustrated in FIG. 1, the control device 1 includes an analog input unit 10, a digital input unit 20, an analog/digital (A/D) conversion unit 30, a random access memory (RAM) 40, and an micro-processing unit (MPU) 50, a read only memory (ROM) 60, an input/output (I/O) port 70, and an output circuit 80.

Analog output signals from various sensors such as the throttle opening sensor 113*a*, the flow rate sensor 114, the accelerator position sensor 126, the upstream air-fuel ratio sensor 162, the downstream air-fuel ratio sensor 163, the combustion pressure sensor 140, and the water temperature sensor 122 are input to the analog input unit 10.

The A/D conversion unit 30 is connected to the analog input unit 10. The analog output signals input from various sensors to the analog input unit 10 are subjected to signal processing such as noise removal, converted into digital signals by the A/D conversion unit 30, and stored in the RAM 40.

The digital output signal from the crank angle sensor 121 is input to the digital input unit 20.

The I/O port 70 is connected to the digital input unit 20, and the digital output signal input to the digital input unit 20 is stored in the RAM 40 via the I/O port 70.

Each output signal stored in the RAM 40 is arithmetically processed by the MPU 50.

The MPU 50 executes a control program (not illustrated) stored in the ROM 60 to arithmetically process the output signal stored in the RAM 40 according to the control program. The MPU 50 calculates a control value that defines the operation amount of each actuator (for example, the throttle valve 113, the pressure regulator 132, and the ignition plug 200) which drives the internal combustion engine 100 according to the control program and temporarily stores the control value in the RAM 40.

The control value which is stored in the RAM 40 and defines the operation amount of the actuator is output to the output circuit 80 via the I/O port 70.

The output circuit 80 is provided with the function of the ignition control unit 83 (see FIG. 3) which controls the voltage applied to the ignition plug 200 or the like.

[Functional Block of Control Device]

Next, the functional configuration of the control device 1 will be described.

Figure 3:
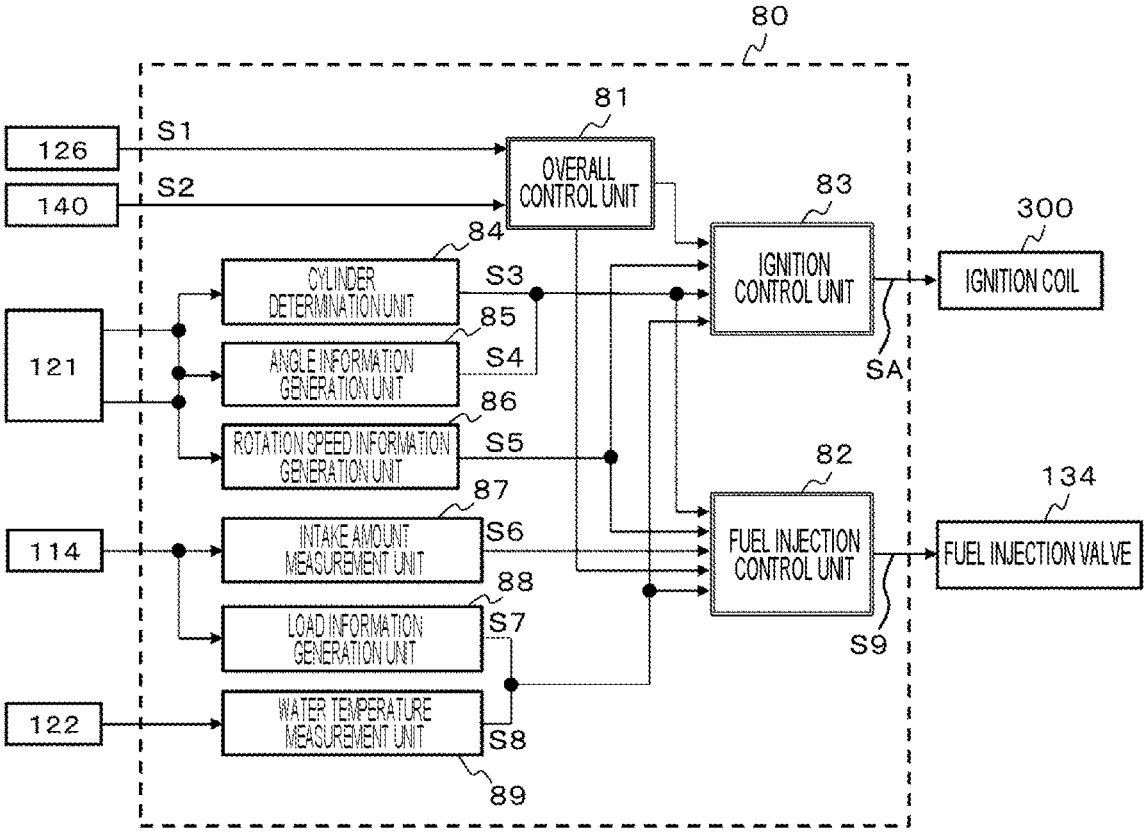
FIG. 3 is a functional block diagram illustrating a functional configuration of a control device.

FIG. 3 is a functional block diagram illustrating the functional configuration of the control device 1. Each function of the control device 1 is realized by the output circuit 80, for example, when the MPU 50 executes the control program stored in the ROM 60.

As illustrated in FIG. 3, the output circuit 80 of the control device 1 includes an overall control unit 81, a fuel injection control unit 82, and an ignition control unit 83.

The overall control unit 81 is connected to an accelerator position sensor 126 and a combustion pressure sensor (CPS) 140 and receives the required torque (acceleration signal S1) from the accelerator position sensor 126 and an output signal S2 from the combustion pressure sensor 140.

The overall control unit 81 performs overall control on the fuel injection control unit 82 and the ignition control unit 83 on the basis of the required torque (acceleration signal S1) from the accelerator position sensor 126 and the output signal S2 from the combustion pressure sensor 140.

The fuel injection control unit 82 is connected to a cylinder determination unit 84 which determines each cylinder 150 of the internal combustion engine 100, an angle information generation unit 85 which measures the crank angle of the crankshaft 123, and a rotation speed information generation unit 86 which measures an engine speed and receives cylinder discrimination information S3 from the cylinder determination unit 84, crank angle information S4 from the angle information generation unit 85, and engine speed information S5 from the rotation speed information generation unit 86.

The fuel injection control unit 82 is connected to an intake amount measurement unit 87 which measures the intake amount of air taken into the cylinder 150, a load information generation unit 88 which measures an engine load, and a water temperature measurement unit 89 which measures the temperature of engine cooling water and receives intake amount information S6 from the intake amount measurement unit 87, engine load information S7 from the load information generation unit 88, and cooling water temperature information S8 from the water temperature measurement unit 89.

The fuel injection control unit 82 calculates the injection amount and the injection time (fuel injection valve control information S9) of fuel injected from the fuel injection valve 134 on the basis of the received information and controls the fuel injection valve 134 on the basis of the calculated injection amount and injection time of fuel.

The ignition control unit 83 is connected to the cylinder determination unit 84, the angle information generation unit 85, the rotation speed information generation unit 86, the load information generation unit 88, and the water temperature measurement unit 89 in addition to the overall control unit 81 and receives each information from these units.

The ignition control unit 83 calculate the amount (energization angle) of current for energizing a primary coil (not illustrated) of the ignition coil 300, an energization start time, and the time to cut off the current (ignition time) energizing the primary coil on the basis of the received information.

The ignition control unit 83 controls the discharge with the ignition plug 200 (ignition control) by outputting an ignition signal SA to a primary coil 310 of the ignition coil 300 on the basis of the calculated energization angle, energization start time, and ignition time.

Incidentally, at least the function of the ignition control unit 83 to control the ignition of the ignition plug 200 using the ignition signal SA corresponds to the internal combustion engine control device of the present invention.

[Electric Circuit of Ignition Coil]

Next, an electric circuit 400 including the ignition coil 300 will be described.

Figure 4:
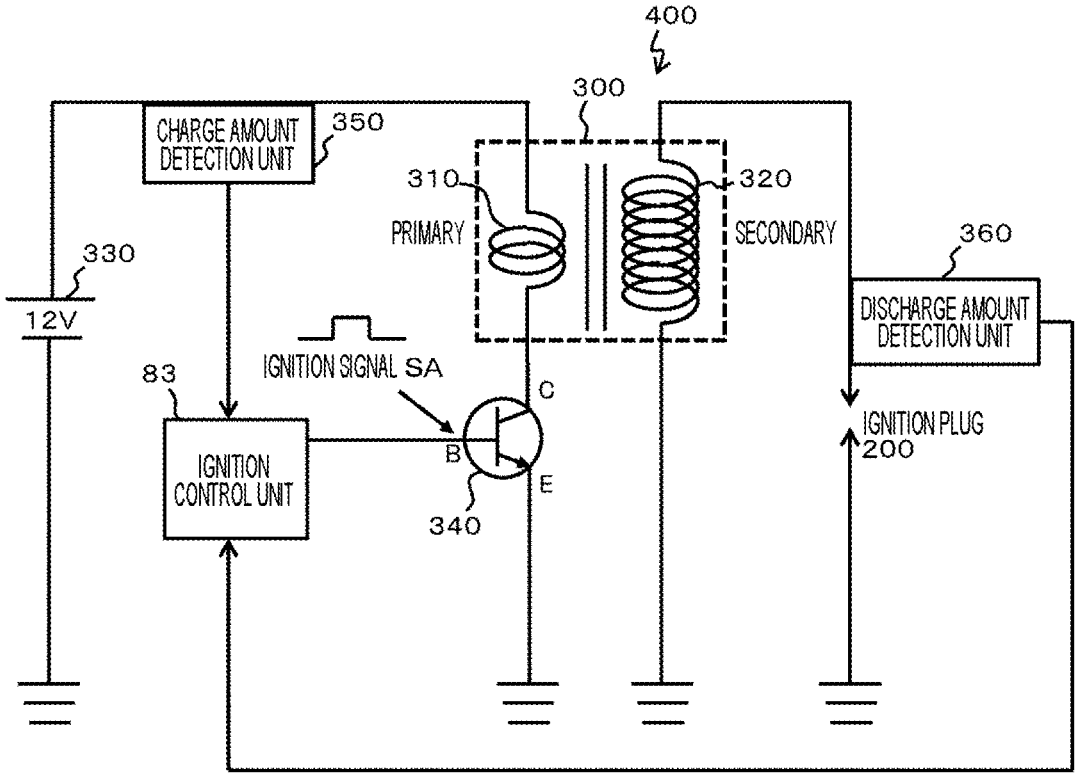
FIG. 4 is a diagram illustrating an electric circuit including an ignition coil.

FIG. 4 is a diagram illustrating the electric circuit 400 including the ignition coil 300. In the electric circuit 400, the ignition coil 300 includes the primary coil 310 wound with a predetermined number of turns and a secondary coil 320 wound with more turns than those in the primary coil 310.

One end of the primary coil 310 is connected to a DC power supply 330. Accordingly, a predetermined voltage (for example, 12 V in the embodiment) is applied to the primary coil 310. A charge amount detection unit 350 is provided in the connection path between the DC power supply 330 and the primary coil 310. The charge amount detection unit 350 detects the voltage and current applied to the primary coil 310 and transmits the detected voltage and current to the ignition control unit 83.

The other end of the primary coil 310 is connected to an igniter 340 and is grounded via the igniter 340. A transistor, a field effect transistor (FET), or the like is used for the igniter 340.

The base (B) terminal of the igniter 340 is connected to the ignition control unit 83. An ignition signal SA output from the ignition control unit 83 is input to the base (B) terminal of the igniter 340. When the ignition signal SA is input to the base (B) terminal of the igniter 340, the collector (C) terminal and the emitter (E) terminal of the igniter 340 are energized, and current flows between the collector (C) terminal and the emitter (E) terminal. Accordingly, the ignition signal SA is output from the ignition control unit 83 to the primary coil 310 of the ignition coil 300 via the igniter 340, and electric power (electrical energy) is accumulated in the primary coil 310.

When the output of the ignition signal SA from the ignition control unit 83 is stopped, and the current flowing through the primary coil 310 is cut off, a high voltage corresponding to the turn number ratio of the coil with respect to the primary coil 310 is generated on the secondary coil 320. When the high voltage generated in the secondary coil 320 is applied to the ignition plug 200 (center electrode 210), a potential difference is generated between the center electrode 210 of the ignition plug 200 and the outer electrode 220. When the potential difference generated between the center electrode 210 and the outer electrode 220 is equal to or higher than the dielectric breakdown voltage Vm of the gas (the air-fuel mixture in the cylinder 150), the dielectric breakdown of the gas component causes the discharge to occur between the central electrode 210 and the outer electrode 220, and the fuel (air-fuel mixture) is ignited.

A discharge amount detection unit 360 is provided in the connection path between the secondary coil 320 and the ignition plug 200. The discharge amount detection unit 360 detects a discharge voltage and a current and transmits the detected discharge voltage and current to the ignition control unit 83.

By the operation of the electric circuit 400 as described above, the ignition control unit 83 controls the energization of the ignition coil 300 by using the ignition signal SA. Accordingly, the ignition control for controlling the ignition plug 200 is performed.

[Relationship Between Ignition Plug Temperature and Air-Fuel Ratio]

Next, the relationship between the temperature of the ignition plug 200 and the air-fuel ratio will be described. At the time of the cold start of the internal combustion engine 100, as the temperature of the electrode of the ignition plug 200 decreases, it is necessary to reduce the air-fuel ratio required for ignition (thicken the fuel).

Figure 5:
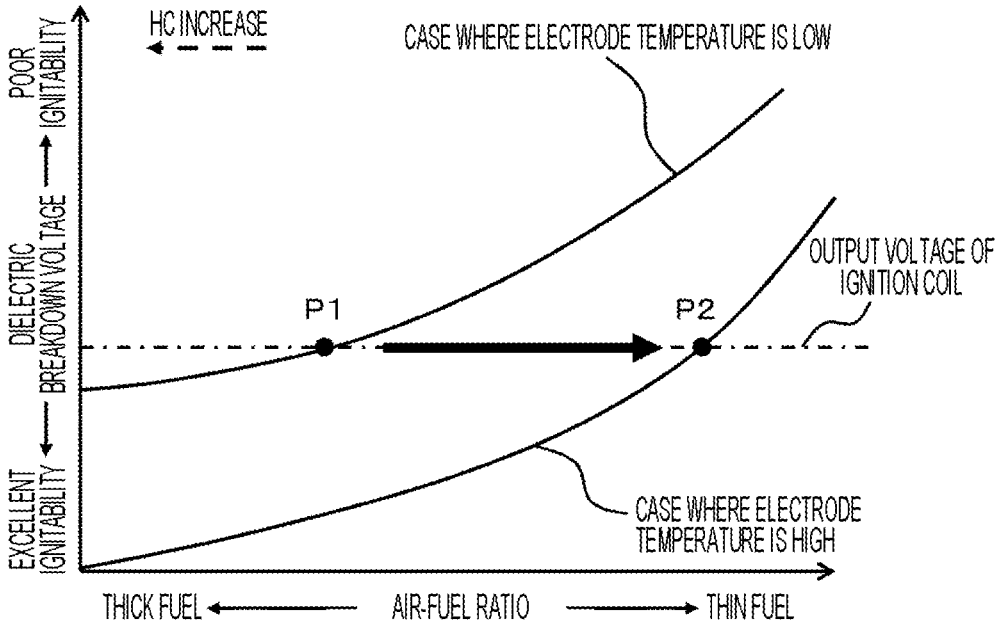
FIG. 5 is a diagram illustrating the relationship among an electrode temperature, a dielectric breakdown voltage, and an air-fuel ratio.

FIG. 5 is a diagram illustrating relationship among the electrode temperature, the dielectric breakdown voltage, and the air-fuel ratio. As illustrated in FIG. 5, in the internal combustion engine 100, when the air-fuel ratio increases (the fuel is thinned), ignition of the air-fuel mixture by discharge (ignition) becomes more difficult, and thus the dielectric breakdown voltage for igniting the air-fuel mixture is required to be increased.

In a case where the dielectric breakdown voltage is constant (the output current of the ignition coil 300 is constant), when the temperature of the electrode of the ignition plug 200 decreases, the breakdown voltage is hardly exceeded unless the air-fuel ratio is reduced (fuel is thickened). As a result, in the internal combustion engine 100, the amount of hydrocarbons (HG) generated during combustion increases as the proportion of fuel in the air-fuel mixture increases.

In other words, when the temperature of the electrode of the ignition plug 200 at the time of cold start increases (see a thick arrow in FIG. 5), the dielectric breakdown voltage can be exceeded although the air-fuel ratio is increased (the fuel is thinned), and the generation of hydrocarbons at the time of combustion can be reduced. Therefore, in the internal combustion engine 100, when the temperature of the electrode of the ignition plug 200 at the time of cold start is increased before discharge (ignition), the generation of hydrocarbons (HC) can be suppressed by increasing the air-fuel ratio at the time of cold start.

In the example illustrated in FIG. 5, in a case where the electrode temperature of the ignition plug 200 is low, the air-fuel ratio for ignition at a predetermined dielectric breakdown voltage is P1, and in a case where the electrode temperature is high, the air-fuel ratio for ignition at the predetermined dielectric breakdown voltage is P2. Therefore, when the electrode temperature increases, the fuel required for ignition can be thinned, and the hydrocarbon (HG) generated by combustion is reduced.

[Output Timing of Ignition Signal]

Next, the output timing of the ignition signal SA will be described regarding the method of heating the electrodes of the ignition plug 200 according to the first embodiment.

Figure 6:
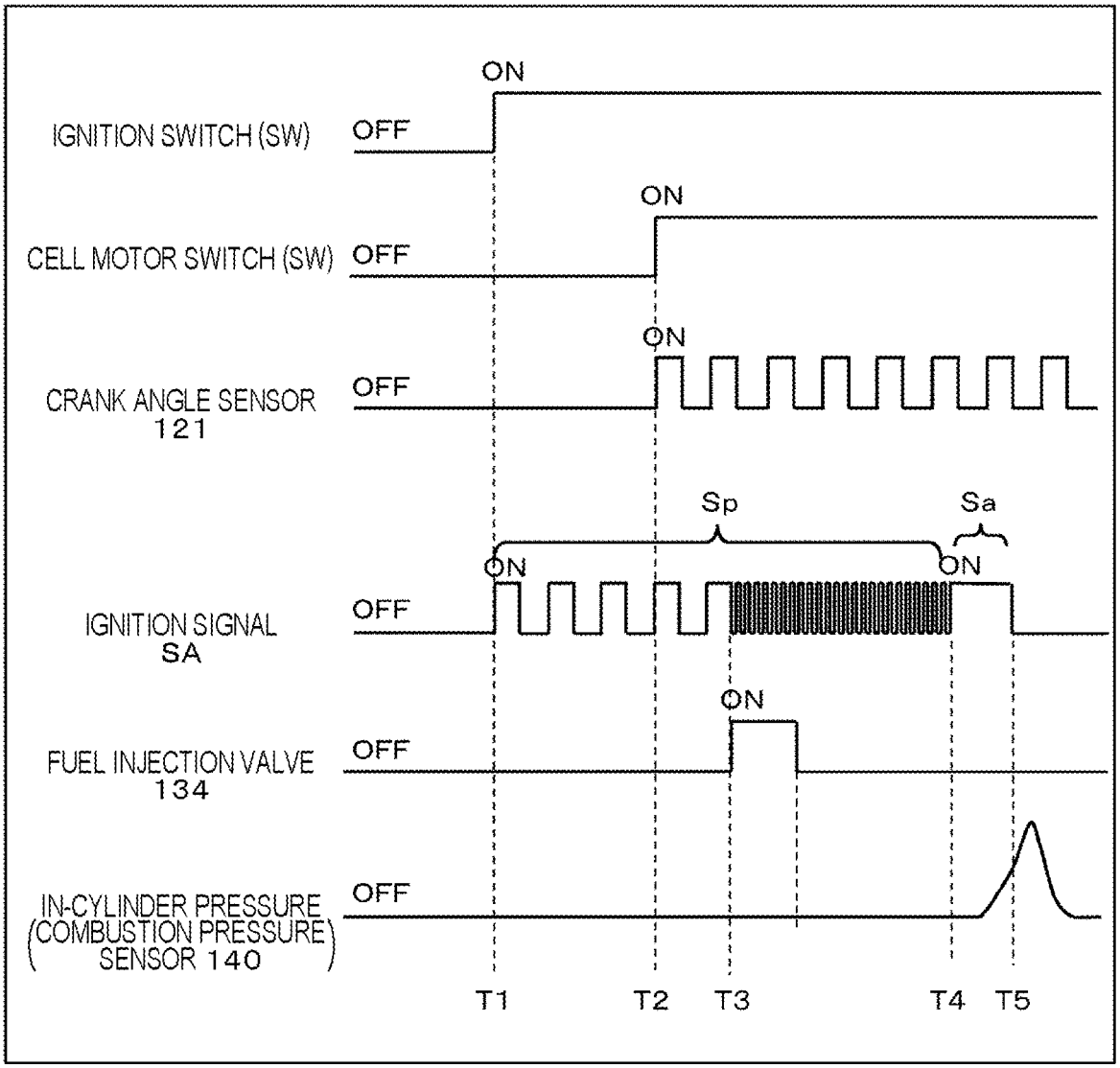
FIG. 6 is an example of a timing chart illustrating an output timing of an ignition signal according to a first embodiment.

FIG. 6 is an example of a timing chart illustrating an output timing of an ignition signal SA according to the first embodiment.

In FIG. 6, the uppermost row shows ON/OFF of the ignition switch of the vehicle (not illustrated). When the driver of the vehicle inserts a key (not shown) into a key cylinder (not illustrated) and turns the key around (or turns on a start button in the case of a keyless device), the ignition switch is turned on.

The third stage from the top shows the output signal of the crank angle sensor 121. After the ignition switch is turned on, a cell motor switch is turned on, and when the crank angle sensor 121 starts detecting the rotation of the crankshaft 123 with the start of movement of the internal combustion engine 100, the output of the crank angle sensor 121 is turned on.

The fourth stage from the top shows the ignition signal SA output from the ignition control unit 83 to the ignition coil 300. The ignition signal SA includes a preliminary ignition signal Sp and a main ignition signal Sa output after the preliminary ignition signal Sp. The preliminary ignition signal Sp is an ignition signal for supplying the pre-heating electrical energy to the ignition plug 200 to increase the temperature of the ignition plug 200 before the ignition plug 200 ignites the fuel (air-fuel mixture) at the time of cold start of the internal combustion engine 100. At the time of cold start, the preliminary ignition signal Sp is output from the ignition control unit 83 to the ignition coil 300, so that the temperature of the electrode of the ignition plug 200 can be increased before discharge (ignition) as described in FIG. 5 described above. Therefore, the generation of hydrocarbons (HG) can be suppressed.

On the other hand, the main ignition signal Sa is an ignition signal for the ignition plug 200 to ignite (ignite) the air-fuel mixture in the combustion stroke of the internal combustion engine 100. The output timing of the main ignition signal Sa is determined by the ignition control unit 83 as described in FIG. 3 described above.

In the first embodiment, the ignition control unit 83 outputs the main ignition signal Sa for causing the ignition plug 200 to discharge electricity (ignition) to the ignition coil 300 from time T4 to time T5 in the combustion stroke in the combustion cycle. Further, in the stroke before the combustion stroke in one combustion cycle, that is, in the stroke before the ignition plug 200 ignites the fuel, the preliminary ignition signal Sp for heating the ignition plug 200 is output to the ignition coil 300. Hereinafter, the heating of the ignition plug 200 by the preliminary ignition signal Sp is also referred to as pre-heating.

As illustrated in FIG. 6, the preliminary ignition signal Sp is repeatedly output a plurality of times after time T1 when the ignition switch is turned on, before time T2 when the signal output from the crank angle sensor 121 is started, and before time T4 when the output of the main ignition signal Sa is started. That is, the preliminary ignition signal Sp is output a plurality of times before the first explosion in each cylinder 150. Here, the first explosion means the first combustion (explosion) in the first combustion stroke of each cylinder 150 after the operation of the internal combustion engine 100 is started. That is, in the internal combustion engine 100, the first explosion occurs in each cylinder 150 only once after the operation is started. After that, a predetermined combustion cycle (intake stroke→compression stroke→combustion stroke→exhaust stroke) is repeated. However, the preliminary ignition signal Sp may be output only once.

As illustrated in FIG. 6, during the period from time T1 to time T4, a pulse signal is continuously output as the preliminary ignition signal Sp at a predetermined duty ratio. The pulse width of the preliminary ignition signal Sp is smaller than the pulse width of the main ignition signal Sa. Accordingly, the preliminary ignition signal Sp is a signal for reducing the voltage change in the ignition coil 300 compared with that of the main ignition signal Sa for combustion (ignition of the air-fuel mixture).

As illustrated in FIG. 6, the cycle of the pulse signal output as the preliminary ignition signal Sp is changed before and after time T3 when the fuel injection from the fuel injection valve 134 is performed. Specifically, after time T3 when the fuel injection from the fuel injection valve 134 is performed, the cycle of the pulse signal is set according to the pulse width of the preliminary ignition signal Sp such that the voltage generated in the ignition coil 300 is less than the dielectric breakdown voltage. Accordingly, after the fuel injection is performed, the pre-heating electric energy supplied from the ignition coil 300 to the ignition plug 200 becomes smaller than that before the fuel injection. Incidentally, before time T3 when the fuel injection from the fuel injection valve 134 is performed, the air-fuel mixture is not ignited. Thus, the voltage generated in the ignition coil 300 according to the preliminary ignition signal Sp may be equal to or higher than the dielectric breakdown voltage or may be less than the dielectric breakdown voltage. Further, the pulse width of the preliminary ignition signal Sp may be larger than the main ignition signal Sa.

As described above, in the first embodiment, the ignition control unit 83 outputs the preliminary ignition signal Sp a plurality of times before outputting the main ignition signal Sa. Accordingly, before the ignition plug 200 ignites the air-fuel mixture (fuel), the ignition control unit 83 controls the energization of the coil 300 so that the ignition coil 300 provides the ignition plug 200 with electric energy for heating the ignition plug 200. At this time, the ignition control unit 83 outputs the pulse signal of the preliminary ignition signal Sp with a pulse width smaller than the pulse signal of the main ignition signal Sa. Accordingly, before the ignition plug 200 ignites the air-fuel mixture (fuel), the ignition control of the ignition plug 200 is executed such that a predetermined pre-heating electric energy smaller than the ignition electric energy is supplied to the ignition plug 200. When a high voltage is applied from the ignition coil 300 to the ignition plug 200 on the basis of the preliminary ignition signal Sp, at the time of cold start of the internal combustion engine 100, the ignition plug 200 (the center electrode 210 and the outer electrode 220) is heated before the first explosion. As a result, as described above, although the air-fuel ratio at the time of discharge (ignition) of the ignition coil 300 in the combustion stroke is increased (the fuel is thinned), the generation of hydrocarbons (HC) due to combustion at the time of cold start can be suppressed.

Next, the fifth stage from the top shows ON/OFF of the fuel injection valve 134. When the fuel injection valve 134 is turned on, a predetermined amount of fuel is injected through the fuel injection valve 134 into the cylinder 150 (combustion chamber).

The bottom row shows the in-cylinder pressure in the cylinder 150 (combustion chamber). The in-cylinder pressure is measured by the combustion pressure sensor 140, and the measurement result of the combustion pressure sensor 140 is output. As described above, in the internal combustion engine 100, after the predetermined amount of fuel is injected through the fuel injection valve 134 to generate the air-fuel mixture in the combustion chamber, the air-fuel mixture is ignited at the timing (time T5) when the main ignition signal Sa is turned off, and combustion occurs. Accordingly, the pressure in the cylinder 150 rapidly increases. The combustion pressure sensor 140 measures the in-cylinder pressure in the combustion cycle.

[Control Method of Ignition Plug]

Figure 7:
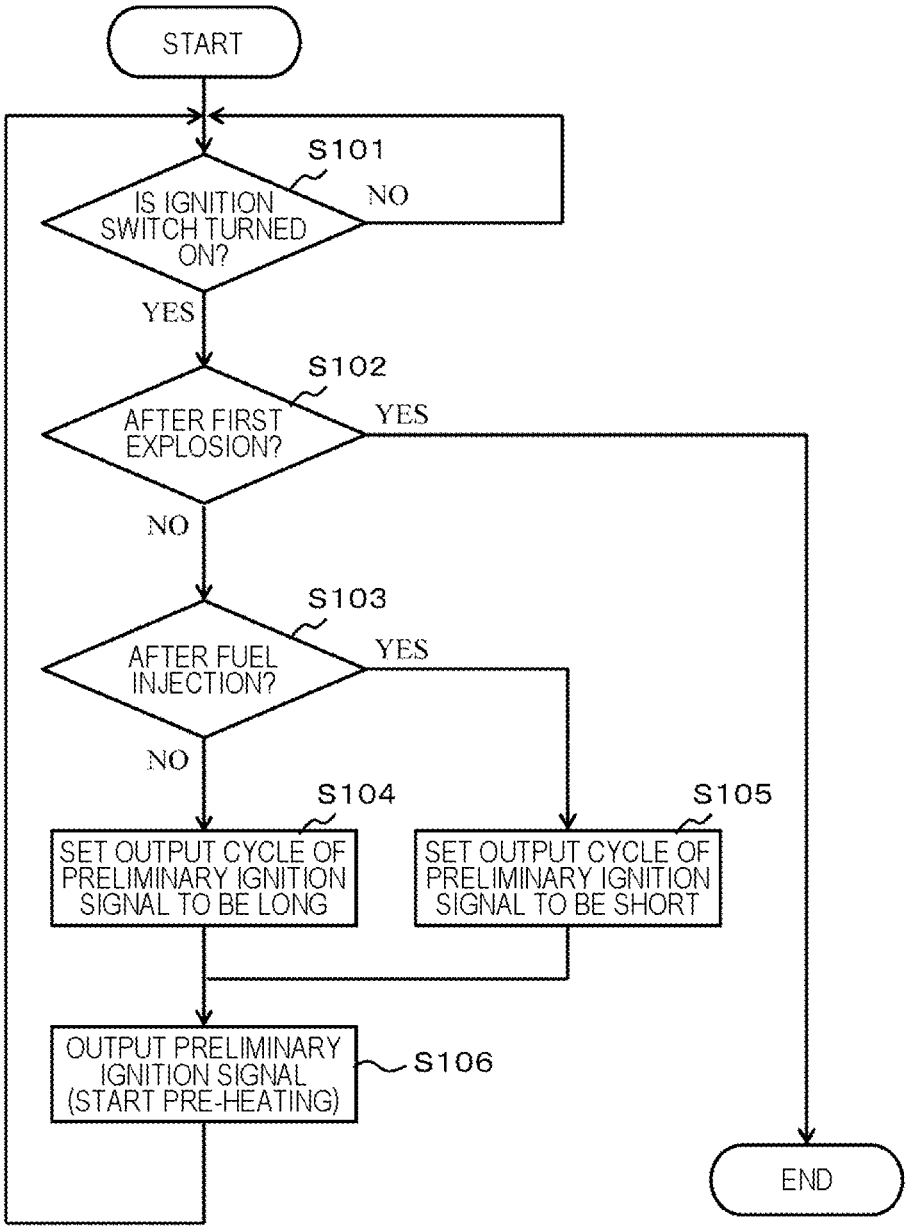
FIG. 7 is an example of a flowchart illustrating a method for controlling an ignition plug by an ignition control unit according to the first embodiment.

Next, an example of a control method of the ignition plug 200 by the ignition control unit 83 will be described. FIG. 7 is an example of a flowchart illustrating a method for controlling the ignition plug 200 by the ignition control unit 83 according to the first embodiment.

As illustrated in FIG. 7, in step S101, the ignition control unit 83 determines whether or not the ignition switch is turned on. As a result, in a case where it is determined that the ignition switch is turned on (step S101: YES), the process proceeds to step S102, and in a case where it is determined that the switch is not turned on, that is, when it is determined to be turned off (step S101: NO), the process returns to step S101.

In step S102, the ignition control unit 83 determines whether or not the cylinder 150 is after the first explosion. In a case where the main ignition signal Sa is turned on even once, it is determined that the cylinder is after the first explosion (step S102: YES), and the process ends as it is. On the other hand, when the main ignition signal Sa is not turned on even once after the ignition switch is turned on, it is determined that the cylinder is before the first explosion (step S102: NO), and the process proceeds to step S103.

In step S103, the ignition control unit 83 determines whether or not fuel is injected into the cylinder 150. In a case where the fuel injection valve 134 is turned on even once, it is determined that the fuel is injected (step S103: YES), and the process proceeds to step S105. On the other hand, when the fuel injection valve 134 is not turned on even once after the ignition switch is turned on, it is determined that the fuel injection is not performed (step S103: NO), and the process proceeds to step S104.

In step S104, the ignition control unit 83 sets the output cycle of the preliminary ignition signal Sp to be long. After step S104 is executed, the ignition control unit 83 proceeds to step S106, and in step S106, outputs the preliminary ignition signal Sp at the output cycle set in step S104. Accordingly, the discharge control (ignition control) on the ignition plug 200 is executed such that the voltage generated in the ignition coil 300 becomes equal to or higher than the dielectric breakdown voltage, and the ignition plug 200 discharges electricity by the pre-heating electric energy supplied from the ignition coil 300 to the ignition plug 200 to generate a spark.

In step S105, the ignition control unit 83 sets the output cycle of the preliminary ignition signal Sp to be short. After step S105 is executed, the ignition control unit 83 proceeds to step S106, and in step S106, outputs the preliminary ignition signal Sp at the output cycle set in step S105. Accordingly, the discharge control (ignition control) on the ignition plug 200 is executed such that the voltage generated in the ignition coil 300 becomes lower than the dielectric breakdown voltage, and a spark is not generated without the ignition plug 200 discharging electricity by the pre-heating electric energy supplied from the ignition coil 300 to the ignition plug 200.

After the preliminary ignition signal Sp is output in step S106, the process returns to step S101. Accordingly, the discharge control (ignition control) on the ignition plug 200 is executed such that the output cycle of the preliminary ignition signal Sp is changed before and after the fuel injection, and the output of the preliminary ignition signal Sp is ended after the first explosion.

As described above, in the first embodiment, the ignition plug 200 provided in the cylinder 150 and the ignition control unit 83 which controls the discharge of the ignition plug 200 are included. In the first combustion cycle after the start of the operation of the internal combustion engine 100, the ignition control unit 83 is configured to supply the pre-heating electric energy from the ignition coil 300 to the ignition plug 200 until the output of the main ignition signal Sa is started after the ignition switch is turned on. With this configuration, the ignition plug 200 can be pre-heated before the first explosion of each cylinder 150 in the internal combustion engine 100, and thus the generation of hydrocarbons (Ho) at the time of cold start can be suppressed.

In the first embodiment, the ignition control unit 83 is configured to supply the pre-heating electric energy from the ignition coil 300 to the ignition plug 200 a plurality of times in the first combustion cycle after the start of the operation of the internal combustion engine 100. With this configuration, the pre-heating of the ignition plug 200 can be reliably performed, so that the generation of hydrocarbons (HC) at the time of cold start can be reliably suppressed.

Figure 8:
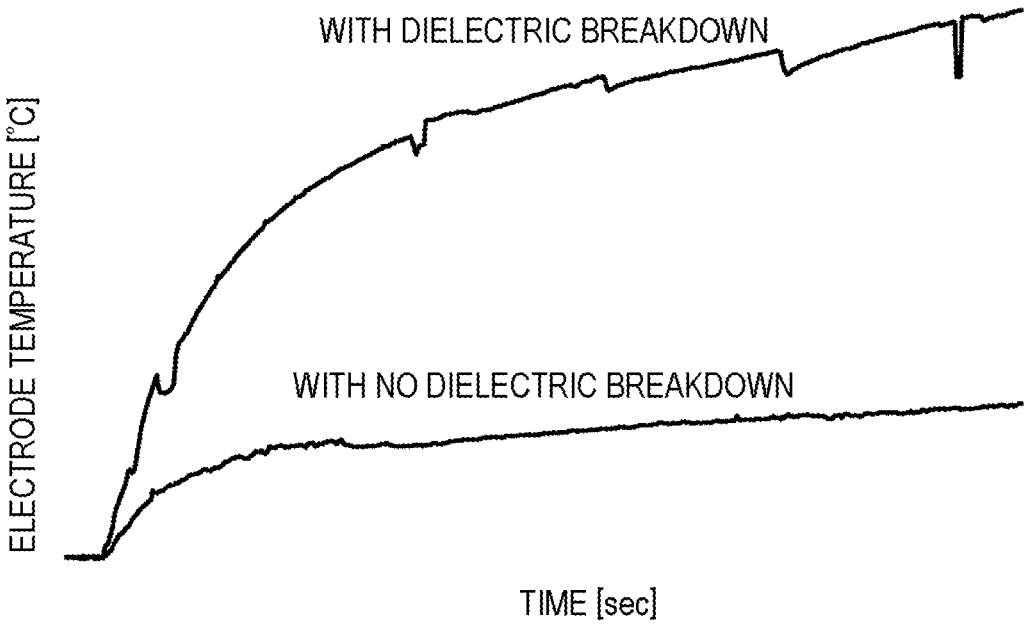
FIG. 8 is a diagram illustrating a time change of the electrode temperature of the ignition plug according to a preliminary ignition signal.

FIG. 8 is a diagram illustrating the time change of the electrode temperature of the ignition plug 200 according to the preliminary ignition signal Sp. In the example illustrated in FIG. 8, in a case where there is a dielectric breakdown, the temperature of the electrode increases faster than in a case where there is no dielectric breakdown. Therefore, in the period in which there is no effect although a discharge occurs due to dielectric breakdown, that is, in the period before the fuel injection valve 134 is turned on, desirably, the preliminary ignition signal Sp is output so that a dielectric breakdown occurs between the center electrode 210 and the outer electrode 220 of the ignition plug 200 due to the electric energy supplied from the ignition coil 300 to the ignition plug 200. On the other hand, when a discharge occurs in the ignition plug 200 after fuel injection, it leads to erroneous ignition during the compression stroke. Thus, it is necessary to prevent dielectric breakdown during pre-heating at this time. Therefore, in the period after the fuel injection valve 134 is turned on, desirably, the preliminary ignition signal Sp is output such that the output cycle of the preliminary ignition signal Sp is changed to be shortened (the pulse width is reduced), so as to prevent a dielectric breakdown between the center electrode 210 and the outer electrode 220 of the ignition plug 200 due to the electric energy supplied from the ignition coil 300 to the ignition plug 200.

According to the first embodiment of the present invention described above, the following operational effects are exhibited.

(1) The internal combustion engine control device includes the ignition control unit 83 which executes an ignition control for controlling the ignition plug 200 which discharges electricity in the cylinder 150 of the internal combustion engine 100 to ignite fuel. The ignition control unit 83 executes the ignition control such that a predetermined ignition electric energy is supplied to the ignition plug 200 when the ignition plug 200 performs ignition, and a predetermined pre-heating electric energy smaller than the ignition electric energy is supplied to the ignition plug 200 before the ignition plug 200 performs ignition. Therefore, it is possible to suppress the generation of hydrocarbons at the time of cold start of the internal combustion engine 100 and to reduce the manufacturing cost of the exhaust catalyst.

(2) The ignition control unit 83 executes the ignition control such that the pre-heating electric energy is supplied to the ignition plug 200 before the fuel injection valve 134 attached to the internal combustion engine 100 injects the fuel (between time T1 and time T3). Therefore, the pre-heating of the ignition plug 200 can be performed at a timing appropriate for suppressing the generation of hydrocarbons at the time of cold start of the internal combustion engine 100.

(3) The ignition control unit 83 executes the ignition control such that the pre-heating electric energy is supplied to the ignition plug 200 between a time when the fuel injection valve 134 attached to the internal combustion engine 100 injects the fuel and a time when the ignition electric energy is supplied to the ignition plug 200 (between time T3 and time T4). Therefore, the pre-heating of the ignition plug 200 can be performed at a timing appropriate for suppressing the generation of hydrocarbons at the time of cold start of the internal combustion engine 100.

(4) The ignition control unit 83 executes the ignition control such that a first electric energy is supplied as the pre-heating electric energy to the ignition plug 200 before the fuel injection valve 134 attached to the internal combustion engine 100 injects the fuel (between time T1 and time T3). Further, the ignition control unit 83 executes the ignition control such that a second pre-heating electric energy is supplied as the pre-heating electric energy to the ignition plug 200 between a time when the fuel injection valve 134 injects the fuel and a time when the ignition electric energy is supplied to the ignition plug 200 (between time T3 and time T4). Here, the first electric energy is larger than the second electric energy. Therefore, it is possible to supply appropriate pre-heating electric energy to the ignition plug 200 before and after fuel injection.

(5) The ignition control unit 83 executes the ignition control such that the ignition plug 200 discharges electricity by the pre-heating electric energy to generate a spark before the fuel injection valve 134 injects the fuel (between time T1 and time T3). Therefore, in the period before the fuel injection without the possibility of erroneous ignition, the pre-heating of the ignition plug 200 can be performed efficiently.

(6) The ignition control unit 83 executes the ignition control such that a spark is not generated without the ignition plug 200 discharging electricity by the pre-heating electric energy between a time when the fuel injection valve 134 injects the fuel and a time when the ignition electric energy is supplied to the ignition plug 200 (between time T3 and time T4). Therefore, it is possible to perform the pre-heating of the ignition plug 200 while preventing erroneous ignition during the compression stroke.

(7) The ignition control unit 83 executes the ignition control such that the pre-heating electric energy is supplied to the ignition plug 200 a plurality of times per ignition. Therefore, the pre-heating of the ignition plug 200 can be performed reliably.

(8) The ignition control unit 83 executes the ignition control such that the pre-heating electric energy is supplied to the ignition plug 200 a plurality of times before the fuel injection valve 134 injects the fuel. Therefore, the pre-heating of the ignition plug 200 can be performed reliably.

(9) The ignition control unit 83 executes the ignition control such that the pre-heating electric energy is supplied to the ignition plug 200 a plurality of times between a time when the fuel injection valve 134 injects the fuel and a time when the ignition electric energy is supplied to the ignition plug 200. Therefore, the pre-heating of the ignition plug 200 can be performed reliably.

(10) The internal combustion engine control device 1 includes the ignition control unit 83 which controls energization of the ignition coil 300 which provides electric energy to the ignition plug 200 which discharges electricity in the cylinder 150 of the internal combustion engine 100 to ignite fuel. The ignition control unit 83 controls the energization of the ignition coil 300 such that the ignition plug 200 is provided with the electric energy for heating the ignition plug 200 before the ignition plug 200 performs the ignition. Therefore, it is possible to suppress the generation of hydrocarbons at the time of cold start of the internal combustion engine 100 and to reduce the manufacturing cost of the exhaust catalyst.

(11) The ignition control unit 83 controls the energization of the ignition coil 300 by continuously transmitting the preliminary ignition signal Sp which is a pulse signal at a first frequency to the igniter 340 connected to the ignition coil 300 before the fuel injection valve 134 attached to the internal combustion engine 100 injects the fuel (between time T1 and time T3). Further, the ignition control unit 83 controls the energization of the ignition coil 300 by continuously transmitting the preliminary ignition signal Sp which is a pulse signal at a second frequency to the igniter 340 between a time when the fuel injection valve 134 injects the fuel and a time when the ignition plug 200 performs the ignition (between time T3 and time T4). Here, the first frequency is lower than the second frequency. Therefore, it is possible to reliably supply appropriate pre-heating electric energy to the ignition plug 200 before and after fuel injection.

(12) The ignition control unit 83 controls the energization of the ignition coil 300 such that the ignition plug 200 is provided with the electric energy for heating the ignition plug 200 before the ignition plug 200 performs the ignition at a time of start of the internal combustion engine 100. Therefore, the electric energy required for the pre-heating of the ignition plug 200 can be reliably supplied from the ignition coil 300 to the ignition plug 200.

Second Embodiment

Next, an internal combustion engine control device according to a second embodiment of the present invention will be described.

In the second embodiment, an example will be described in which the control device 1 performs ignition control so that discharge (ignition) is generated in the ignition plug 200 during the exhaust stroke in the combustion cycle. Incidentally, the configurations of the internal combustion engine 100 and the control device 1 according to the second embodiment are the same as those of the first embodiment, and thus the description thereof is omitted below.

[Output Timing of Ignition Signal]

The output timing of the ignition signal SA according to the second embodiment will be described below.

Figure 9:
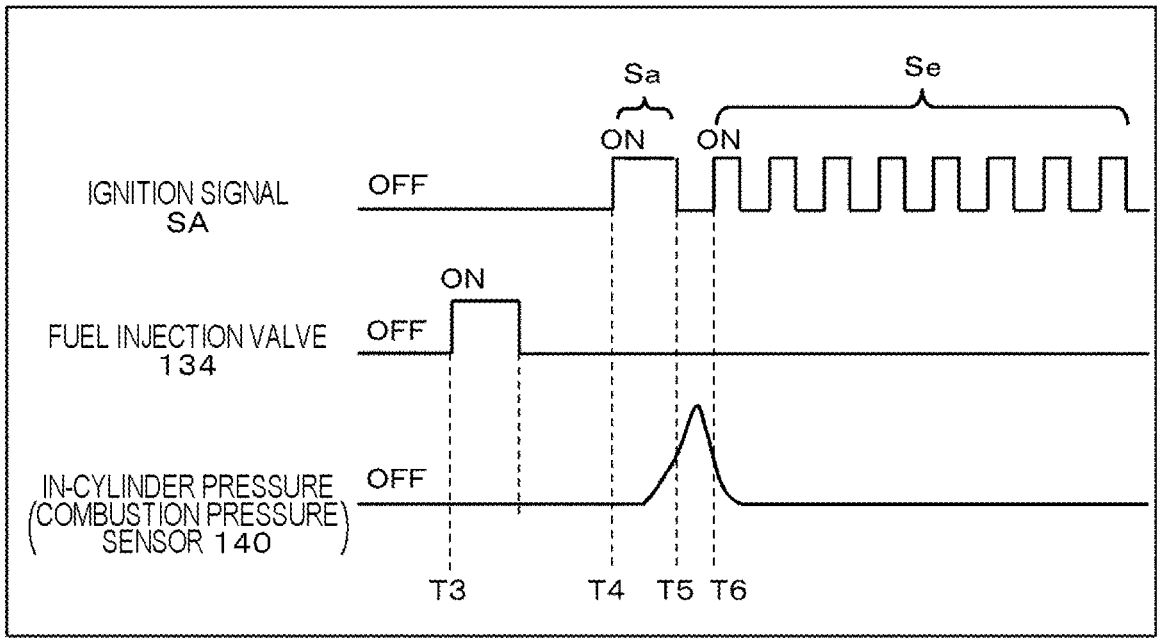
FIG. 9 is an example of a timing chart illustrating an output timing of an ignition signal according to a second embodiment.
Figure 9:
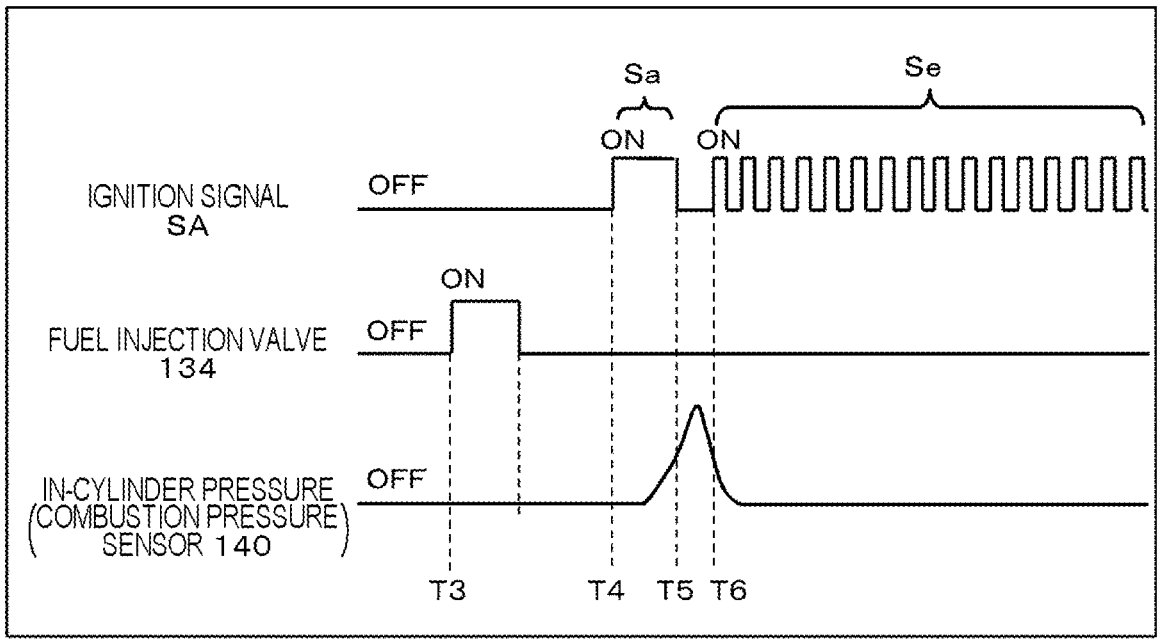

FIG. 9 is an example of a timing chart illustrating the output timing of the ignition signal SA according to the second embodiment. FIG. 9(*a*) is an example of a timing chart of the time of cold start of the internal combustion engine 100, and FIG. 9(*b*) is an example of a timing chart after warming-up (during steady operation) of the internal combustion engine 100.

In FIGS. 9(*a*) and 9(*b*), each uppermost row shows the ignition signal SA output from the ignition control unit 83 to the ignition coil 300. The ignition signal SA includes the main ignition signal Sa and an exhaust ignition signal Se output after the main ignition signal Sa. Similarly to the first embodiment, the main ignition signal Sa is an ignition signal for the ignition plug 200 to ignite the air-fuel mixture in the combustion stroke of the internal combustion engine 100.

On the other hand, the exhaust ignition signal Se is an ignition signal to supply the ignition plug 200 with the electric energy for causing the ignition plug 200 to discharge electricity in the period including at least the exhaust stroke of the internal combustion engine 100. When the exhaust ignition signal Se is output from the ignition control unit 83 to the ignition coil 300, the ignition plug 200 can be caused to discharge electricity even during the exhaust stroke in which the combusted fuel is discharged from the cylinder 150. Accordingly, it is conceivable that the fuel in the air-fuel mixture which cannot be combusted in the combustion stroke, such as fuel adhering to the wall surface of the cylinder 150 or the crown surface of the piston 170, can be ignited and combusted during exhaust. As a result, the generation of hydrocarbons (HC) can be suppressed.

In the second embodiment, the ignition control unit 83 outputs the main ignition signal Sa for causing the ignition plug 200 to discharge electricity (ignition) to the ignition coil 300 from time T4 to time T5 in the combustion stroke in the combustion cycle. Further, the exhaust ignition signal Se for causing the ignition plug 200 to discharge electricity (ignition) is output to the ignition coil 300 in the period after the combustion stroke in one combustion cycle, that is, in the period including at least the exhaust stroke.

As illustrated in FIG. 9, the exhaust ignition signal Se is repeatedly output a plurality of times from time T6 after time T5 when the output of the main ignition signal Sa is ended. That is, the exhaust ignition signal Se is output in the period including at least the exhaust stroke in each cylinder 150 so that the ignition plug 200 performs a plurality of times of discharges. Here, the exhaust stroke is a period in which the exhaust valve 152 is opened after the combustion stroke of the internal combustion engine 100, and thus exhaust including the combusted fuel is discharged from each cylinder 150. However, the exhaust ignition signal Se may be output only once.

As illustrated in FIG. 9, in the period after time T6, a pulse signal is continuously output as the exhaust ignition signal Se at a predetermined duty ratio. The pulse width of the exhaust ignition signal Se is smaller than the pulse width of the main ignition signal Sa. Accordingly, the discharge cycle of the ignition plug 200 by the exhaust ignition signal Se in the exhaust stroke is shorter than the discharge cycle of the ignition plug 200 by the main ignition signal Sa in the combustion stroke.

Comparing FIG. 9(*a*) and FIG. 9(*b*), the cycle of the pulse signal output as the exhaust ignition signal Se, that is, the discharge cycle of the ignition plug 200 in the exhaust stroke is changed at the time of cold start and after warming up. For example, at the time of cold start illustrated in FIG. 9 (*a*), the cycle (the discharge cycle of the ignition plug 200) of the exhaust ignition signal Se is set within the range from 233 Hz to 10 kHz, and after the warming-up illustrated in FIG. 9 (*b*), the cycle (the discharge cycle of the ignition plug 200) of the exhaust ignition signal Se is set within the range from 1 kHz to 10 kHz. Accordingly, the lower limit value of the discharge cycle of the ignition plug 200 in the exhaust stroke is changed according to the time elapsed after the start of the internal combustion engine 100. Incidentally, herein, the cycle of the exhaust ignition signal Se is changed in two steps but may be changed in three or more steps. Further, the voltage generated in the ignition coil 300 according to the exhaust ignition signal Se is preferably equal to or higher than the dielectric breakdown voltage so that the ignition plug 200 discharges electricity, and the pulse width of the exhaust ignition signal Se may be larger than that of the main ignition signal Sa.

As described above, in the second embodiment, the ignition control unit 83 outputs the exhaust ignition signal Se a plurality of times in the period including at least the exhaust stroke after outputting the main ignition signal Sa. Accordingly, during the exhaust stroke, the ignition control unit 83 controls the energization of the ignition coil 300 so that the ignition coil 300 provides the ignition plug 200 with the electric energy for causing the ignition plug 200 to discharge electricity. When a high voltage is applied from the ignition coil 300 to the ignition plug 200 on the basis of the exhaust ignition signal Se, the ignition plug 200 is discharged during the exhaust stroke of the internal combustion engine 100, and the fuel in the air-fuel mixture which cannot be combusted in the combustion stroke can be ignited and combusted.

As a result, although the air-fuel ratio at the time of discharge (ignition) of the ignition coil 300 in the combustion stroke is increased (the fuel is thinned), the generation of hydrocarbons (HC) can be suppressed.

Next, in FIGS. 9(*a*) and 9(*b*), the second stage from the top shows ON/OFF of the fuel injection valve 134. When the fuel injection valve 134 is turned on, a predetermined amount of fuel is injected through the fuel injection valve 134 into the cylinder 150 (combustion chamber).

The bottom row shows the in-cylinder pressure in the cylinder 150 (combustion chamber). The in-cylinder pressure is measured by the combustion pressure sensor 140, and the measurement result of the combustion pressure sensor 140 is output. As described above, in the internal combustion engine 100, after the predetermined amount of fuel is injected through the fuel injection valve 134 to generate the air-fuel mixture in the combustion chamber, the air-fuel mixture is ignited at the timing (time T5) when the main ignition signal Sa is turned off, and combustion occurs. Accordingly, the pressure in the cylinder 150 rapidly increases. The combustion pressure sensor 140 measures the in-cylinder pressure in the combustion cycle.

[Control Method of Ignition Plug]

Figure 10:
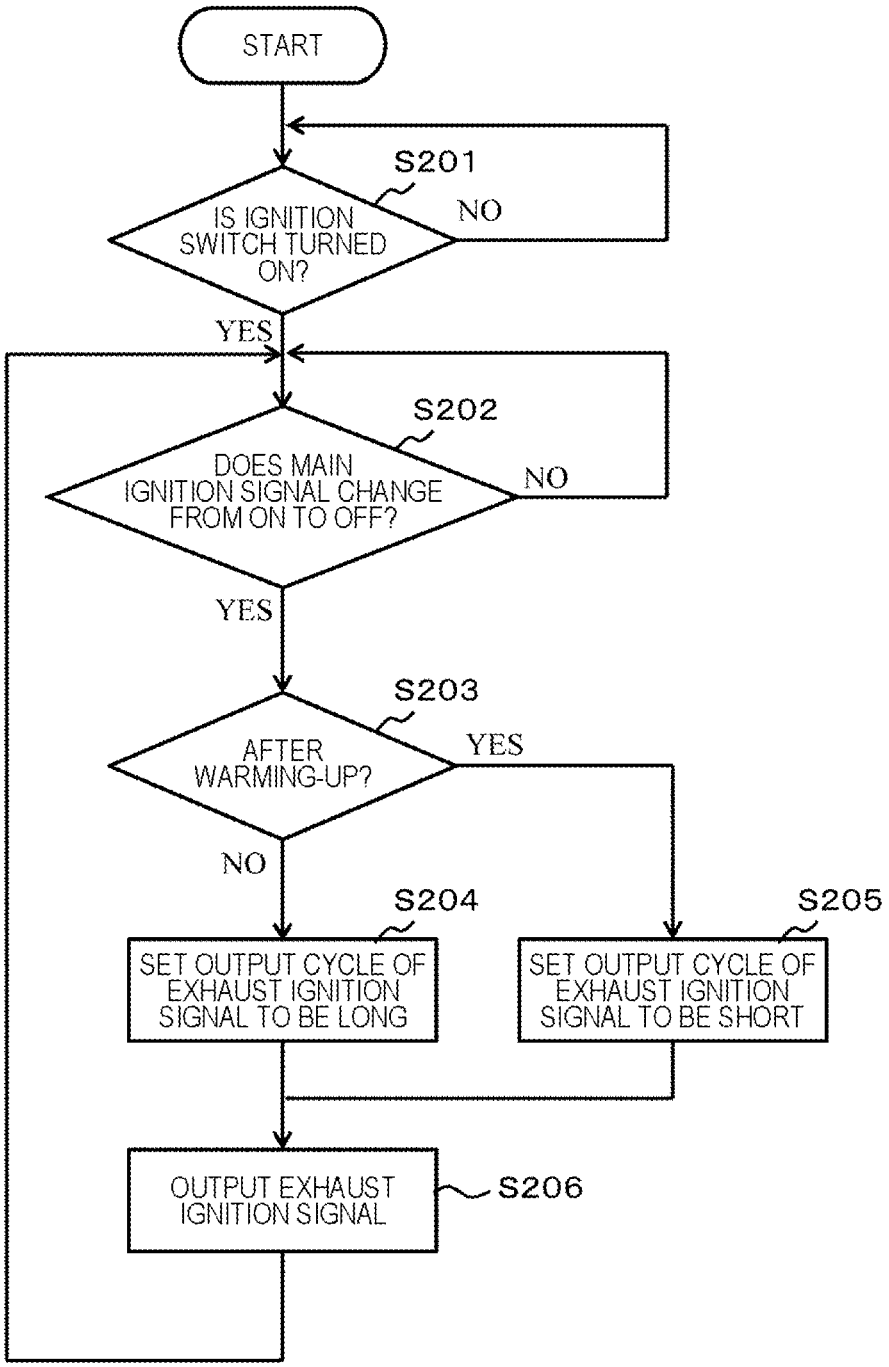
FIG. 10 is an example of a flowchart illustrating a method for controlling an ignition plug by an ignition control unit according to the second embodiment.

Next, an example of a control method of the ignition plug 200 by the ignition control unit 83 will be described. FIG. 10 is an example of a flowchart illustrating a method for controlling the ignition plug 200 by the ignition control unit 83 according to the second embodiment.

As illustrated in FIG. 10, in step S201, the ignition control unit 83 determines whether or not the ignition switch is turned on. As a result, in a case where it is determined that the ignition switch is turned on (step S201: YES), the process proceeds to step S202, and in a case where it is determined that the switch is not turned on, that is, when it is determined to be turned off (step S201: NO), the process returns to step S201.

In step S202, the ignition control unit 83 determines whether or not the main ignition signal Sa changes from ON to OFF. In a case where the main ignition signal Sa changes from ON to OFF, that is, a case where the ignition plug 200 discharges to ignite the air-fuel mixture (step S202: YES), the process proceeds to step S203, and in a case where it is determined that the signal does not change from ON to OFF (step S202: NO), the process returns to step S202.

In step 3203, the ignition control unit 83 determines whether or not the operating state of the internal combustion engine 100 is a state after warming up. In a case where the state is a state after warming up, that is, in a case where a certain amount of time elapses since the internal combustion engine 100 starts to operate, and the internal combustion engine is a steady operating state (step S203: YES), the process proceeds to step S205. On the other hand, in a case where the state is not a state after warming up, that is, at the time of cold start of the internal combustion engine 100 (step S203: NO), the process proceeds to step S204.

In step 3204, the ignition control unit 83 sets the output cycle of the exhaust ignition signal Se to be long. After step S204 is executed, the ignition control unit 83 proceeds to step 3206, and in step S206, outputs the exhaust ignition signal Se at the output cycle set in step S204. Accordingly, the discharge control (ignition control) on t ignition plug 200 is executed such that the ignition plug 200 discharge electricity by the electric energy supplied from the ignition coil 300 to the ignition plug 200 during the exhaust stroke to generate a spark.

In step S205, the ignition control unit 83 sets the output cycle of the exhaust ignition signal Se to be short. After step S205 is executed, the ignition control unit 83 proceeds to step S206, and in step S206, outputs the exhaust ignition signal Se at the output cycle set in step S205. Accordingly, the discharge control (ignition control) on the ignition plug 200 is executed such that the ignition plug 200 discharge electricity by the electric energy supplied from the ignition coil 300 to the ignition plug 200 during the exhaust stroke to generate a spark.

After the exhaust ignition signal Se is output in step S206, the process returns to step S202. Accordingly, every time the ignition plug 200 discharges, and the combustion stroke is performed, the discharge control (ignition control) on the ignition plug 200 is executed such that the exhaust ignition signal Se is output in the period including at least the subsequent exhaust stroke, and the output cycle of the exhaust ignition signal Se is changed at the time of cold start and after warming-up. Incidentally, when a predetermined time elapses since the internal combustion engine 100 starts to operate, the processing illustrated in the flowchart of FIG. 10 may be ended, and the output of the exhaust ignition signal Se may be stopped.

As described above, in the second embodiment, the ignition plug 200 provided in the cylinder 150 and the ignition control unit 83 which controls the discharge of the ignition plug 200 are included. The ignition control unit 83 is configured to supply electric energy from the ignition coil 300 to the ignition plug 200 in the period including at least the exhaust stroke of the internal combustion engine 100. With this configuration, the fuel left in the air-fuel mixture discharged from each cylinder 150 in the internal combustion engine 100 can be combusted, and thus the generation of hydrocarbons (HC) at the time of cold start can be suppressed.

In the second embodiment, the ignition control unit 83 is configured to supply the discharging electric energy from the ignition coil 300 to the ignition plug 200 a plurality of times in the period including at least the exhaust stroke of the internal combustion engine 100. With this configuration, the ignition plug 200 can reliably discharge electricity during the exhaust stroke, so that the generation of hydrocarbons (HC) can be reliably suppressed.

According to the second embodiment of the present invention described above, the following operational effects are exhibited.

(1) The internal combustion engine control device 1 includes the ignition control unit 83 which executes an ignition control for controlling the ignition plug 200 which discharges electricity in the cylinder 150 of the internal combustion engine 100 to ignite fuel. The ignition control unit 83 executes the ignition control such that the electric energy for causing the ignition plug 200 to discharge electricity is supplied to the ignition plug 200 in a period including at least the exhaust stroke in which the fuel after combustion is discharged from the cylinder 150 (a period after time T6). Therefore, it is possible to suppress the generation of hydrocarbons at the time of cold start of the internal combustion engine 100 and to reduce the manufacturing cost of the exhaust catalyst.

(2) The exhaust stroke is a period during which the exhaust valve 152 of the internal combustion engine 100 is open. Therefore, by opening the exhaust valve 152, it is possible to reliably combust the fuel left in the air-fuel mixture discharged from each cylinder 150 and to suppress the generation of hydrocarbons.

(3) The ignition control unit 83 executes the ignition control such that the ignition plug 200 discharges electricity a plurality of times during the period. Therefore, the ignition plug 200 can be reliably caused to discharge electricity during the exhaust stroke, and the fuel left in the discharged air-fuel mixture can be combusted.

(4) A discharge cycle of the ignition plug 200 in the period is shorter than a discharge cycle when the ignition plug 200 ignites the fuel during the combustion stroke. Therefore, it is possible to reliably combust the fuel left in the air-fuel mixture discharged from the cylinder 150 at any timing during the exhaust stroke.

(5) The ignition control unit 83 executes the ignition control such that the discharge cycle of the ignition plug 200 in the period is within a range from a predetermined lower limit value to an upper limit value, and the lower limit value is changed according to a time elapsed after start of the internal combustion engine 100. Therefore, the generation of hydrocarbons can be reliably suppressed both at the time of cold start and after warming-up.

Incidentally, the first embodiment and the second embodiment described above may be combined. That is, at the time of cold start of the internal combustion engine 100, the ignition control unit 83 outputs the preliminary ignition signal Sp before the first explosion to pre-heat the ignition plug 200 and outputs the exhaust ignition signal Se to discharge the ignition plug 200 in the period including at least the exhaust stroke, thereby suppressing the generation of hydrocarbons (HC). Further, after the warming-up (during steady operation) of the internal combustion engine 100, the ignition control unit 83 outputs the exhaust ignition signal Se to discharge the ignition plug 200 in the period including at least the exhaust stroke, thereby suppressing the generation of hydrocarbons (HC). With this configuration, the internal combustion engine control device 1 can be configured to achieve the respective operational effects described in the first embodiment and the second embodiment.

In each of the embodiments described above, each functional configuration of the control device 1 described in FIG. 3 may be realized by software executed by the MPU 50 as described above, or another hardware such as a field-programmable gate array (FPGA). In addition, these may be mixed and used.

The embodiments and various modifications described above are merely examples, and the present invention is not limited to these contents unless the characteristics of the invention are impaired. Further, although various embodiments and modifications have been described above, the present invention is not limited to these contents. Other embodiments considered within the scope of the technical idea of the present invention are also included within the scope of the present invention.

REFERENCE SIGNS LIST

1 control device
10 analog input unit
20 digital input unit
30 A/D conversion unit
40 RAM
50 MPU
60 ROM
70 I/O port
80 output circuit
81 overall control unit
82 fuel injection control unit
83 ignition control unit
84 cylinder determination unit
85 angle information generation unit
86 rotation speed information generation unit
87 intake amount measurement unit
88 load information generation unit
89 water temperature measurement unit
100 internal combustion engine
110 air cleaner
111 intake pipe
112 intake manifold
113 throttle valve
113*a* throttle opening sensor
114 flow rate sensor
115 intake air temperature sensor
120 ring gear
121 crank angle sensor
122 water temperature sensor
123 crankshaft
125 accelerator pedal

126 accelerator position sensor
130 fuel tank
131 fuel pump
132 pressure regulator
133 fuel pipe
134 fuel injection valve
140 combustion pressure sensor
150 cylinder
151 intake valve
152 exhaust valve
160 exhaust manifold
161 three-way catalyst
162 upstream air-fuel ratio sensor
163 downstream air-fuel ratio sensor
170 piston
200 ignition plug
210 center electrode
220 outer electrode
230 insulator
300 ignition coil
310 primary coil
320 secondary coil
330 DC power supply
340 igniter
350 charge amount detection unit
360 discharge amount detection unit
400 electric circuit

The invention claimed is:

1. An internal combustion engine control device comprising:

an ignition control unit which executes an ignition control for controlling an ignition plug which discharges electricity in a cylinder of an internal combustion engine to ignite fuel, wherein the ignition control unit executes the ignition control such that a predetermined ignition electric energy is supplied to the ignition plug when the ignition plug performs the ignition, and a predetermined pre-heating electric energy smaller than the ignition electric energy is supplied to the ignition plug before the ignition plug performs the ignition.

2. The internal combustion engine control device according to claim 1, wherein the ignition control unit executes the ignition control such that the pre-heating electric energy is supplied to the ignition plug before a fuel injection valve attached to the internal combustion engine injects the fuel.

3. The internal combustion engine control device according to claim 2, wherein the ignition control unit executes the ignition control such that the ignition plug discharges electricity by the pre-heating electric energy to generate a spark before the fuel injection valve injects the fuel.

4. The internal combustion engine control device according to claim 2, wherein the ignition control unit executes the ignition control such that the pre-heating electric energy is supplied to the ignition plug a plurality of times before the fuel injection valve injects the fuel.

5. The internal combustion engine control device according to claim 1, wherein the ignition control unit executes the ignition control such that the pre-heating electric energy is supplied to the ignition plug between a time when a fuel injection valve attached to the internal combustion engine injects the fuel and a time when the ignition electric energy is supplied to the ignition plug.

6. The internal combustion engine control device according to claim 5, wherein the ignition control unit executes the ignition control such that a spark is not generated without the ignition plug discharging electricity by the pre-heating electric energy between a time when the fuel injection valve injects the fuel and a time when the ignition electric energy is supplied to the ignition plug.

7. The internal combustion engine control device according to claim 5, wherein the ignition control unit executes the ignition control such that the pre-heating electric energy is supplied to the ignition plug a plurality of times between a time when the fuel injection valve injects the fuel and a time when the ignition electric energy is supplied to the ignition plug.

8. The internal combustion engine control device according to claim 1, wherein the ignition control unit executes the ignition control such that a first electric energy is supplied as the pre-heating electric energy to the ignition plug before a fuel injection valve attached to the internal combustion engine injects the fuel, the ignition control unit executes the ignition control such that a second electric energy is supplied as the pre-heating electric energy to the ignition plug between a time when the fuel injection valve injects the fuel and a time when the ignition electric energy is supplied to the ignition plug, and the first electric energy is larger than the second electric energy.

9. The internal combustion engine control device according to claim 1, wherein the ignition control unit executes the ignition control such that the pre-heating electric energy is supplied to the ignition plug a plurality of times per ignition.

10. The internal combustion engine control device according to claim 1, wherein the ignition control unit executes the ignition control such that an electric energy for causing the ignition plug to discharge electricity is supplied to the ignition plug in a period including at least an exhaust stroke in which the fuel after combustion is discharged from the cylinder.

11. The internal combustion engine control device according to claim 10, wherein the exhaust stroke is a period during which an exhaust valve of the internal combustion engine is open.

12. The internal combustion engine control device according to claim 10, wherein the ignition control unit executes the ignition control such that the ignition plug discharges electricity a plurality of times during the period.

13. The internal combustion engine control device according to claim 12, wherein a discharge cycle of the ignition plug in the period is shorter than a discharge cycle when the ignition plug performs the ignition.

14. The internal combustion engine control device according to claim 13, wherein the ignition control unit executes the ignition control such that the discharge cycle of the ignition plug in the period is within a range from a predetermined lower limit value to an upper limit value, and the lower limit value is changed according to a time elapsed after start of the internal combustion engine.

15. An internal combustion engine control device comprising:

an ignition control unit which controls energization of an ignition coil which provides electric energy to an ignition plug which discharges electricity in a cylinder of an internal combustion engine to ignite fuel, wherein the ignition control unit controls the energization of the ignition coil such that the ignition plug is provided with the electric energy for heating the ignition plug before the ignition plug performs the ignition, the ignition control unit controls the energization of the ignition coil by continuously transmitting a pulse signal at a first frequency to an igniter connected to the ignition coil before a fuel injection valve attached to the internal combustion engine injects the fuel, the ignition control unit controls the energization of the ignition coil by continuously transmitting a pulse signal at a second frequency to the igniter between a time when the fuel injection valve injects the fuel and a time when the ignition plug performs the ignition, and the first frequency is lower than the second frequency.

16. The internal combustion engine control device according to claim 15, wherein the ignition control unit controls the energization of the ignition coil such that the ignition plug is provided with the electric energy for heating the ignition plug before the ignition plug performs the ignition at a time of start of the internal combustion engine.

* * * * *